US008750080B2

(12) United States Patent
Tran et al.

(10) Patent No.: US 8,750,080 B2
(45) Date of Patent: Jun. 10, 2014

(54) INSTANTANEOUS DRIVING MECHANISM FOR TIMEPIECE MOVEMENT

(71) Applicant: Pequignet S.A., Morteau (FR)

(72) Inventors: Huy Van Tran, La Chaux-de-Fonds (CH); Ludovic Perez, Villers-le-Lac (FR)

(73) Assignee: Pequignet S.A., Morteau (FR)

( * ) Notice: Subject to any disclaimer, the term of this patent is extended or adjusted under 35 U.S.C. 154(b) by 0 days.

(21) Appl. No.: 14/034,533

(22) Filed: Sep. 23, 2013

(65) Prior Publication Data

US 2014/0022874 A1 Jan. 23, 2014

Related U.S. Application Data

(63) Continuation of application No. PCT/EP2012/055268, filed on Mar. 23, 2012.

(51) Int. Cl.
*G04B 19/02* (2006.01)
*G04B 19/20* (2006.01)

(52) U.S. Cl.
USPC ..... 368/220; 368/35; 368/37

(58) Field of Classification Search
USPC ..... 368/28, 25, 37, 220, 221
See application file for complete search history.

(56) References Cited

U.S. PATENT DOCUMENTS 3,350,873 A 11/1967 Egger et al.
3,597,917 A * 8/1971 Odagiri ..... 368/35
3,982,388 A * 9/1976 Guyot et al. ..... 368/35
6,711,100 B2 * 3/2004 Rochat et al. ..... 368/35
2003/0151984 A1 * 8/2003 Speichinger et al. ..... 368/190
2007/0147177 A1 6/2007 Zaugg et al.

FOREIGN PATENT DOCUMENTS

DE 20 60 056 A1 6/1972
EP 1 406 131 A1 4/2004
EP 1 801 671 A1 6/2007
EP 1 857 890 A2 11/2007
EP 1 918 792 A1 5/2008

OTHER PUBLICATIONS

International Search Report of PCT International Application No. PCT/EP2012/055268, dated May 31, 2012, 5 pages.
Preliminary Search Report of FR 1152402, dated Dec. 19, 2011, 2 pages.

* cited by examiner

*Primary Examiner* — Vit W Miska
(74) *Attorney, Agent, or Firm* — Finnegan, Henderson, Farabow, Garrett & Dunner, LLP

(57) ABSTRACT

An instantaneous driving mechanism for a timepiece movement is disclosed. The driving mechanism may include a mobile comprising a first wheel driven by a driving member of the timepiece movement and configured to drive rotation of a first cam of the mobile. The driving mechanism may also include a lever mounted pivotally on at least one frame element of the timepiece movement, the lever being configured to cooperate with the mobile in order to be moved and to cooperate with a counter of the timepiece movement to increment the counter by instantaneous pulses. The first cam may be coaxial with the first wheel and have a periphery of varying radius. In addition, the first cam may be configured to cooperate with a nose carried by a first arm of the lever and to move the first arm progressively away from the center of the mobile.

20 Claims, 15 Drawing Sheets

Fig. 8
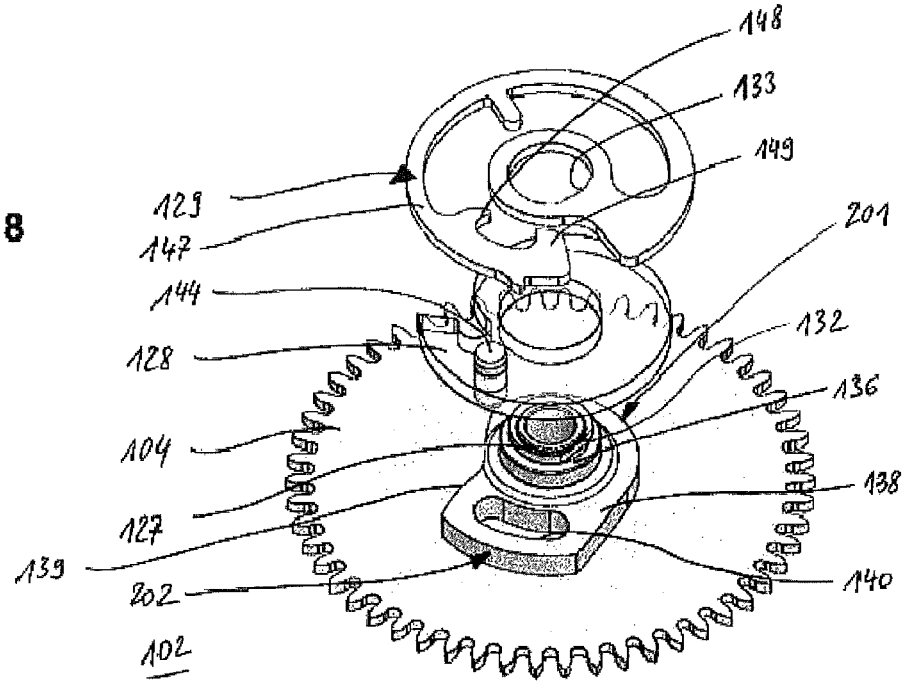
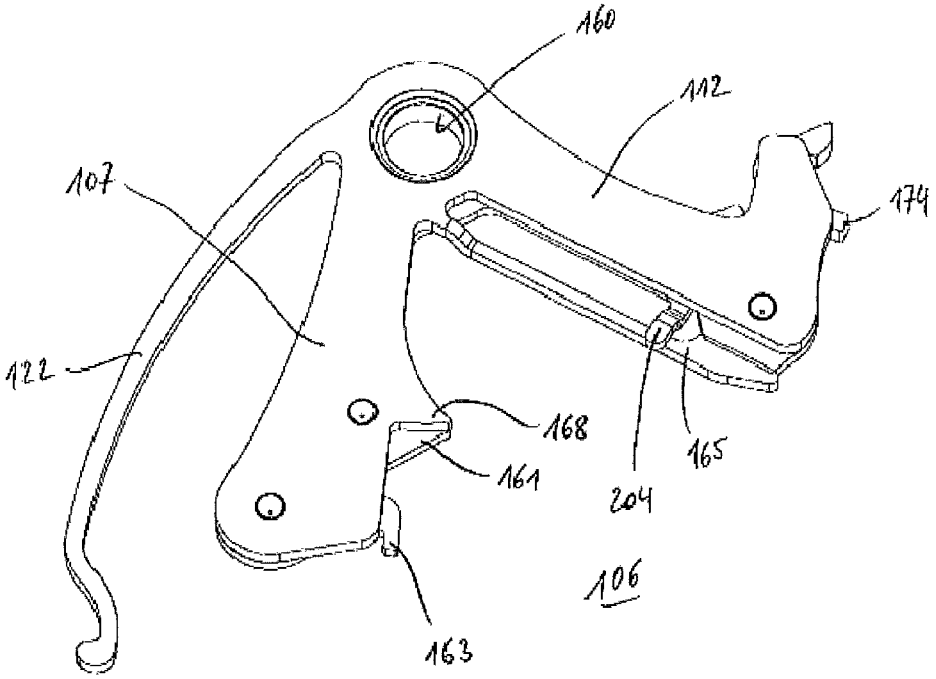
Fig. 9a

INSTANTANEOUS DRIVING MECHANISM FOR TIMEPIECE MOVEMENT

This application is a continuation application of prior International Application No. PCT/EP2012/055268, filed Mar. 23, 2012 and claiming priority to French (FR) Patent Application No. 1152402, filed Mar. 23, 2011. The disclosures of the above-referenced applications are expressly incorporated herein by reference to their entireties.

TECHNICAL FIELD

The present disclosure relates to the field of timepieces. More particularly, and without limitation, the present disclosure relates to an instantaneous driving mechanism for timepiece movements, including a mobile and a lever configured to be mounted pivotally on at least one frame element of the timepiece movement. The lever may be adapted to cooperate, on the one hand, with the mobile in order to be moved and, on the other hand, with a counter of the timepiece movement, with the aim of incrementing it by means of instantaneous pulses. The mobile may also comprise a first wheel, configured to be driven from a driving member of the timepiece movement, and, configured to drive rotation of a first cam of the mobile, coaxial with the first wheel and having a periphery of varying radius. The later may be configured to cooperate with a nose carried by a first arm of the lever and move it progressively away from the center of the mobile when the later turns in a first rotation direction, before allowing it to fall, by virtue of the effect of the action of spring means, when the nose moves from a point on the periphery corresponding to the largest radius to a point on the periphery corresponding to the smallest radius.

BACKGROUND

Driving mechanisms for timepieces have been disclosed. For example, European patent application EP 1406131 A1 describes a timepiece mechanism adapted to drive successive instantaneous jumps of disks showing the current hour and minute. This mechanism includes, for each of the two time units to be displayed, a mobile comprising a driving wheel and a cam coaxial with this wheel and having a periphery of varying radius, to be more precise of sawtooth shape. The cam is constrained to rotate with the driving wheel, the latter being driven from a finishing wheel. A pivoting lever is arranged to cooperate on the one hand with the cam, via a nose, and, on the other hand, with a counter of the corresponding time unit, via a lever carrying a pawl with which it meshes.

Spring means are provided for pressing the nose against the periphery of the cam at all times; the lever therefore pivots when the nose follows the rising profile of a sawtooth of the cam, before falling when the nose is facing the radial face of the same tooth. The nose falling, and therefore the lever returning to its position nearest the cam, leads to instantaneous incrementing of the counter of the corresponding time unit.

However, in the description of the above EP application, the applicant acknowledges a drawback of this type of mechanism, namely the fact that the cam can be driven in only one rotation direction, given the orientation of its teeth. Accordingly, this document provides a device for correction of the current time adapted to prevent any rotation of the cam in the wrong rotation direction. To be more precise, this correction device enables the current time to be modified without using the levers.

The use of such a correction device is nevertheless not always desirable, in particular if the information to be displayed has a greater number of possible values, for example the date. It will also be noted that the display of some information, such as the date, for example, is generally controlled by the same means as control the display of the current time. In this case, manual correction of the current time may damage the mechanism for instantaneously driving this information.

European patent EP 1918792 B1 describes a corrector mechanism associated with a similar driving mechanism enabling both forward and backward correction of the value of a time indication. To this end, this corrector mechanism includes a return lever arranged in the same plane in the vicinity of the lever cooperating with the cam to control the display of the time indication to raise the lever by means of a setting wheel and to move its nose out of reach of the periphery of the cam when a backward correction is made.

SUMMARY

The present disclosure includes embodiments that improve on conventional mechanisms and provide an alternative to known timepiece movements, including mechanisms for controlling a display that jumps instantaneously, by proposing a mechanism in which a cam with which a lever cooperates may be driven in both rotation directions, to prevent any damage during manual correction, as well as having a limited overall size in the plane of the corresponding timepiece movement.

The present disclosure relates more particularly to embodiments of an instantaneous driving mechanism of the type referred to above wherein the mobile may comprise a safety body, coaxial with the driving wheel and configured to cooperate with the lever to move the first arm away from the center of the mobile when the later turns in the second rotation direction and to allow the nose to go from the point corresponding to the smallest radius to the point corresponding to the largest radius.

By virtue of these features, a driving mechanism in accordance with the present disclosure enables rapid correction of information to be displayed or other information linked to it, notably by allowing rotation in both directions of the cam controlling the pulses transmitted by the lever to the first counter.

The safety body may include a kinematic connection with the first cam such that they are angularly mobile relative to each other between first and second relative angular positions. A first of these relative angular positions may be associated with the first rotation direction and the nose may cooperate with the cam to define a position of the lever. At least one other position may be associated with the second rotation direction and the safety body may cooperate with the lever to define a position.

In some embodiments, the safety body may include a plate coaxial with the first cam and having a slope at its periphery, inclined relative to the radial direction and extending between points respectively corresponding to the smallest radius and the largest radius of the plate. In some embodiments, the plate and the first cam may be advantageously constrained to rotate together by means of a spring member configured to allow relative angular movement thereof between the first and second positions.

The mobile may include a pin fastened to one of the elements comprising the first cam and the safety body, and a portion of which may be arranged in a slot of predefined length provided in the other of the elements comprising the first cam and the safety body to define the two relative angular positions. The mobile may further include a spring member including a base constrained to rotate with that of the elements including the slot and a finger adapted to cooperate with the pin so as to tend to position the first cam and the safety body in the direction of the first relative angular position.

By virtue of the above features, the cam and the safety body may be driven relative to each other as a function of the rotation direction of the mobile, so that whichever of these two elements is able to move the lever away acts on the latter if necessary.

In accordance with some embodiments, the lever may include a first retractable finger configured to act at least indirectly on the first counter and to transmit the pulses to it, the lever further may include a retractor device driven by the mobile and configured to act on the first retractable finger and, on the one hand, to move it so that it is out of reach of the first counter during the phase during which the first arm of the lever is moved away from the center of the mobile and, on the other hand, to release it before the lever falls so that it can transmit a pulse to the first counter.

The retractor device may include a follower pivotally mounted on the lever and configured to cooperate, on the one hand, with the periphery of the plate of the safety body, the latter having a radius increasing from the point with the smallest radius to the point with the largest radius, and, on the other hand, at least indirectly with the first retractable finger.

By virtue of these features, the finger actuating the counter may not come into contact with the latter during the phase during which it is positioned on the upstream side thereof, thus maintaining correct operation of the corresponding timepiece movement.

In accordance with some embodiments, the retractable finger may be fastened to a guide member and configured to cooperate with a fixed pin, in particular, housed in a frame element of the corresponding timepiece movement. In this case, the cooperation of the guide member with the pin may follow a path predefined as a function of the movements of the lever. The latter moreover may include a spring member configured to define a rest position of the guide member relative to the lever and exerting on it a force contributing to defining the predefined path.

A mechanism in accordance with the present disclosure may be used to increment instantaneously a second counter of the timepiece movement. Accordingly, the lever may include a second arm adapted to cooperate with the second counter of the timepiece movement, with the aim of incrementing it by means of instantaneous pulses substantially simultaneous with those incrementing the first counter.

In this case, the lever may include a second retractable finger configured to act at least indirectly on the second counter and to transmit the pulses to it, the retractor device being configured to act also on the second finger and, on the one hand, to move it so that it is out of reach of the second counter during the phase during which the first arm of the lever is far away from the center of the mobile, and, on the other hand, to release it before the lever falls so that it can transmit a pulse to the second counter.

The retractor device may also include a rocker mounted to pivot on the lever and having first and second ends configured to cooperate with the first and second retractable fingers, respectively. Accordingly, retraction of one of the fingers leads to retraction of the other finger.

A mechanism in accordance with the present disclosure may, for example, be used to control simultaneously by instantaneous jumps display of the date and the day.

BRIEF DESCRIPTION OF THE DRAWINGS

Other features and advantages of the present disclosure will become more clearly apparent on reading the following detailed description, given with reference to the appended drawings, which are provided by way of non-limiting examples, and in which:

FIG. 8 represents an exploded perspective view of a member similar to that from FIG. 2 in another embodiment of the present disclosure;

FIG. 9*a* represents a perspective view of a first face of a member similar to that from FIGS. 3*a* and 3*b* in the another embodiment of the present disclosure;

DETAILED DESCRIPTION OF EMBODIMENTS

Figure 1:
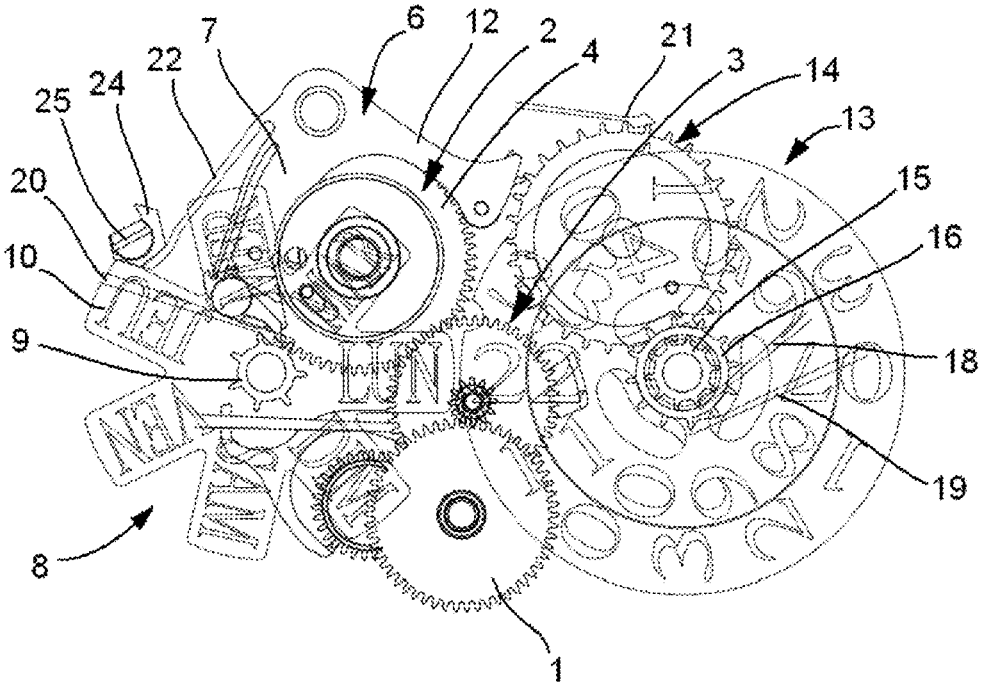
FIG. 1 represents a simplified front view of an instantaneous driving mechanism for timepiece movements, according to an embodiment of the present disclosure.

FIG. 1 represents a simplified front view of an instantaneous driving mechanism for timepiece movements, according to an embodiment of the present disclosure. To be more precise, the mechanism represented may control the display of the date, in the "grande date" format, as well as the day.

To this end, and by way of nonlimiting example, the mechanism may include a finishing wheel connecting a time base to a conventional driving member (not shown). The finishing wheel may drive an hour wheel 1 in rotation at the rate of one complete turn every 12 hours.

The hour wheel 1 may be kinematically connected to a mobile 2 of the driving mechanism via a set of setting wheels 3, configured so as to mesh with a first toothed wheel 4 of the mobile 2, so that the later revolves on itself once every 24 hours.

The mobile 2 may cooperate with a lever 6 in a manner described in more detail hereinafter to increment the counters for the date and the day instantaneously and substantially simultaneously every 24 hours.

The lever 6 may include a first arm 7 configured to increment a first counter 8 showing the days of the week by transmitting pulses to a gear 9 with seven teeth fastened to a disk 10 showing the day.

The lever 6 may additionally include a second arm 12 configured to increment a second counter 13 showing the date by transmitting pulses to a two-stage driving wheel 14 configured to drive the movements of two gears 15 and 16 fastened to the date units digit and tens digit disks, respectively, to provide a conventional "grande date" format display.

Jumper springs 18, 19, 20 and 21 may be provided in the known manner to ensure correct angular positioning of the disks and the driving wheel.

It will also be noted that a spring 22 may be formed integrally with the lever 6 so that it cooperates with the mobile 2. The spring 22 is disposed so as to bear against a cam 24 retained on a frame element of the timepiece movement by means of a screw 25. The periphery of the cam 24 features a succession of segments at a greater or lesser distance from the center of the cam. A spring-loading effect of the spring 22 may thus be adjusted as a function of the segment against which it is bearing.

Figure 2:
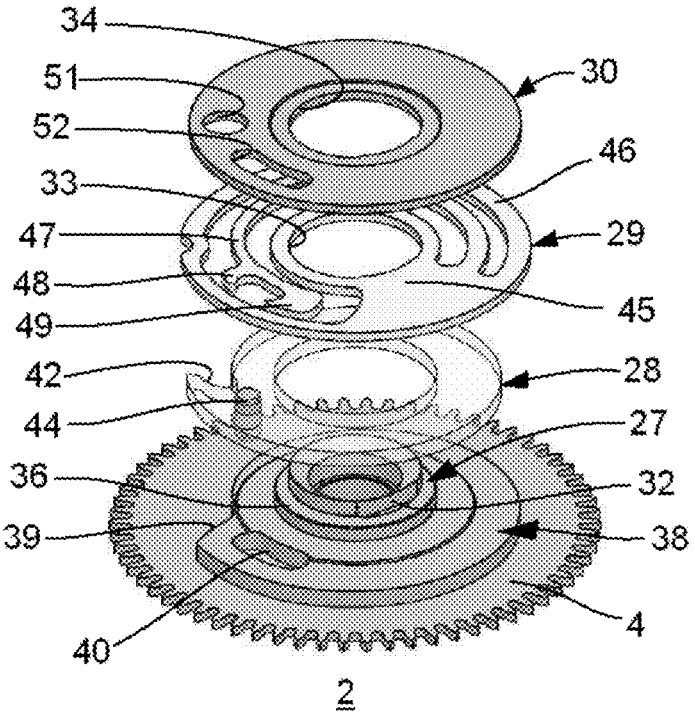
FIG. 2 represents an exploded perspective view of a first member of the exemplary mechanism from FIG. 1.

FIG. 2 represents an exploded perspective view of the mobile 2, according to an embodiment of the present disclosure.

The first toothed wheel 4 may be fastened to a bush 27 on which a cam 28, a spring member 29 and a retaining plate 30 may be engaged. The hollow central shaft of the bush 27 may be adapted to be engaged over a tenon carried by a frame element of the timepiece movement to mount the mobile pivotally thereon.

The bush 27 may include a flat 32 with which openings 33, 34 of complementary shape are provided in the spring member 29 and the retaining plate 30. By virtue of this arrangement, the bush 27, the spring member 29, and the retaining plate 30 may be constrained to rotate together.

Moreover, the bush 27 may include a shoulder 36 defining a radial guide surface for the cam 28 mounted on the bush 27 and free to turn relative to the latter.

The bush 27 may also carry a safety body 38, the operation of which is described hereinafter. The safety body 38 may be fastened to the bush 27, and therefore, the toothed wheel 4 so as to rotate with them.

The safety body 38 may include a plate. The periphery of the plate may have a varying radius, more precisely a radius which increases substantially continuously between a smallest radius and a largest radius. A slope 39 inclined relative to the radial direction may define the junction between the points of largest and smallest radius. The safety body 38 may further comprise a slot 40 extending substantially along a circular trajectory.

The cam 28 may be positioned on the bush 27 adjacent the safety body 38. The cam 28 also may include a periphery of varying radius, for example, a radius which increases substantially continuously between a smallest radius and a largest radius. The junction 42 between the points of largest and smallest radius may include a curvature situated between the region of the periphery corresponding to the largest radii and the center of the cam so as to define a sudden interruption of the periphery after the point of largest radius in the direction of the point of smallest radius.

Furthermore, the cam 28 may carry a pin 44 configured to cooperate with the slot 40 of the safety body, as explained in more detail hereinafter.

The spring member 29 may comprise a base 45 for retaining it on the bush 27. A peripheral ring 46 and a spring arm 47 of substantially circular general shape may extend from the base 45. The spring arm 47 may include two fingers 48, 49 in the shape of claws oriented toward each other at its free end. The fingers 48, 49 may be adapted to cooperate with the pin 44 carried by the cam 28 so as to move it one way or the other in the slot 40. When the mobile 2 is assembled and is not subjected to any external loading, the pin 44 may be free to assume a position between the two claws 48 and 49.

The retaining plate 30 may have the general shape of a ring and may include two windows 51, 52, the presence of which is illustrative. The two windows 51, 51 may enable a detail of the mechanism to be used in operation. The main function of the retaining plate may include ensuring that the spring arm 47 is not deformed out of its operating plane.

Figure 3A:
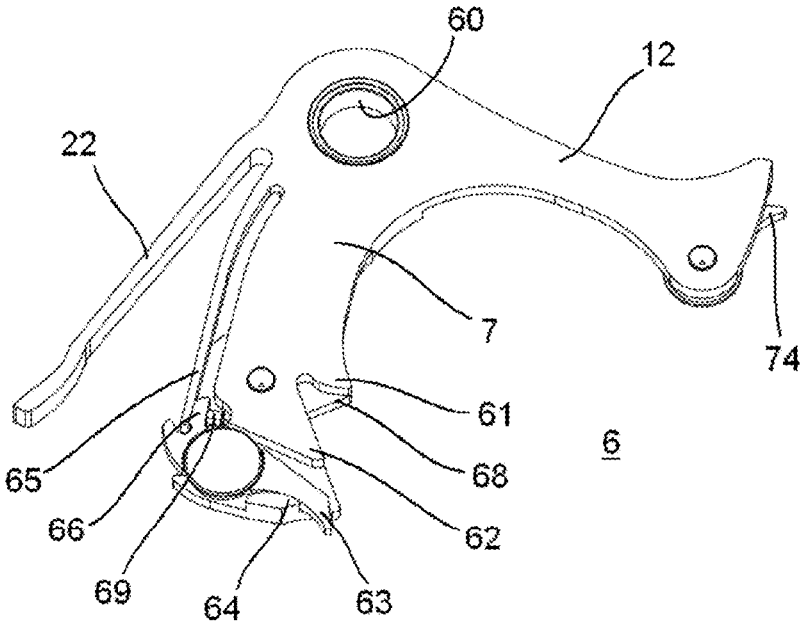
FIG. 3*a* represents a perspective view of a first face of a second member of the exemplary mechanism from FIG. 1.
Figure 3B:
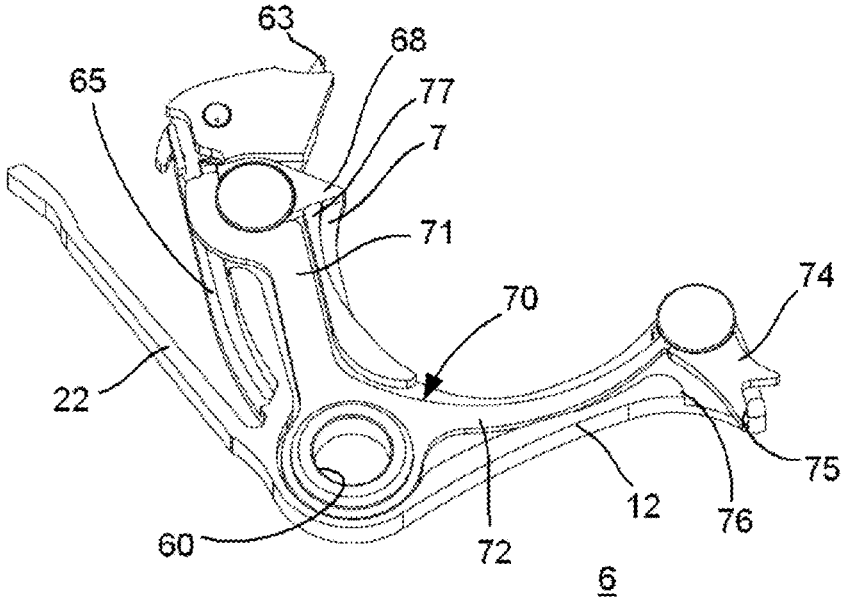
FIG. 3*b* represents a perspective view of a second face of the second member from FIG. 3*a;*

FIGS. 3*a* and 3*b* represent perspective views of the first and second faces of the lever 6 configured to cooperate with the mobile 2 described above.

The lever 6 may include a bore 60 enabling it to be pivotally fixed to a frame element of the timepiece movement.

The first arm 7 may comprise, near its free end, a first nose 61 configured to cooperate with the periphery of the cam 28, followed by a second nose 62 defining a first abutment surface for a first retractable finger 63, mounted pivotally on the first arm 7 and configured to transmit pulses to the gear 9 of the day counter 8. A second abutment surface 64 may be provided to define a range of relative movement of the first retractable finger. A spring 65, which may be in one piece with the lever 6, may be provided to apply a force to the first retractable finger via an extension 66, tending to hold it abutted against the second abutment surface 64.

Moreover, the first arm 7 may carry a follower 68 configured to cooperate with the periphery of the safety body 38 and pivotally mounted on the first arm.

The lever 6 may carry a rocker 70, which may be rotatably mounted on the lever, with a rotation axis coaxial with the bore 60 and featuring first and second arms 71, 72 respectively superposed on the first and second arms 7, 12 of the lever.

The free end of the first arm 71 of the rocker may be arranged in the vicinity of the follower 68 and may include a bent portion 69 arranged so that it is abutted against the rear of the follower 68, so that the latter may drive pivoting of the rocker simultaneously with pivoting of the first retractable finger 63, when it pivots. The bent portion may be arranged so that it may exert on the extension 66 a force acting in the opposite direction to that of the spring 65, to move the first retractable finger away from the second abutment surface 64. The free end of the second arm 72 of the rocker may cooperate with a second retractable finger 74 to cause it to pivot substantially simultaneously with the first retractable finger 63. First and second abutment surfaces 75, 76 on the second arm 12 may limit the travel of the second retractable finger 74 in both rotation directions.

It will also be noted that an additional abutment surface 77 on the first arm 7 of the lever may limit the travel of the follower 68.

FIGS. 4*a* to 4*d* show the kinematics of operation of the instantaneous driving mechanism, according to an embodiment of the present disclosure, in a first rotation direction. FIGS. 4*a* to 4*d* are shown in a similar simplified front view to that of FIG. 1. In this embodiment, the first rotation direction is the direction of normal operation of the mechanism, i.e. when it is driven by the finishing wheel. In such an operation, the hour wheel 1 may turn in the clockwise rotation direction in FIGS. 4*a* to 4*d*, which corresponds to rotation of the mobile 2 in the anticlockwise rotation direction.

Figure 4A:
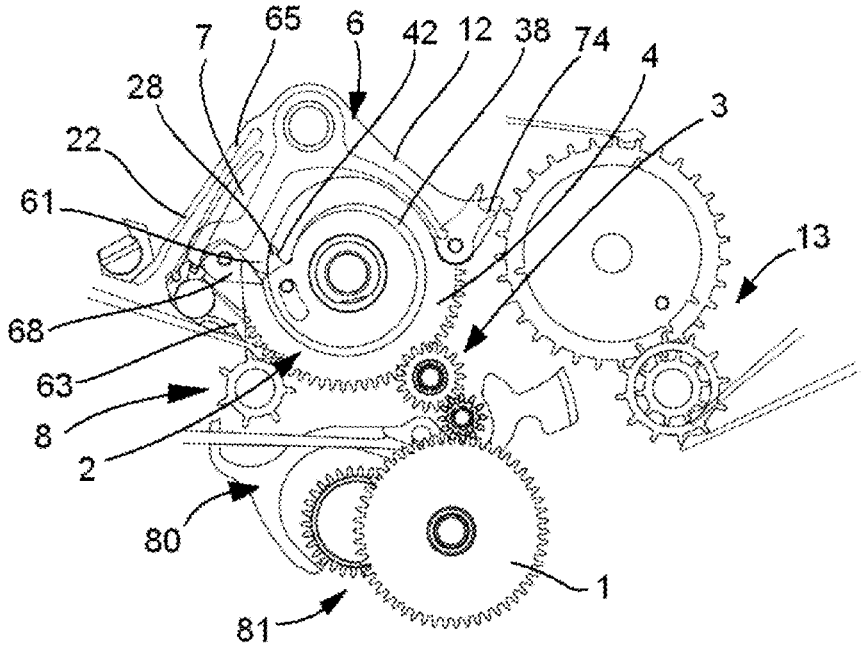
FIGS. 4*a*, 4*b*, 4*c* and 4*d* represent the kinematics of the operation of the exemplary mechanism from FIG. 1, in a first rotation direction, in the same simplified front view.

Starting from the smallest radius of the periphery of the cam 28, associated with a time immediately after midnight on a given day (FIG. 4*d*), the nose 61 may follow the periphery of the cam 28 for almost 24 hours, as far as the position shown in FIG. 4*a*, which corresponds to a time just after midnight on the next day. In fact, the wheel 4 being driven in the anticlockwise rotation direction, the wheel 4 may drive the cam 28 in the same direction through cooperation of its slot 40 with the pin 44 carried by the cam 28.

The radius of the periphery of the cam 28 may increase progressively, the lever may pivot slowly in the clockwise direction at the same time, so that its first arm 7 may move progressively away from the center of the cam 28.

The follower 68 may follow the periphery of the safety body 38, the radius of which, starting from its substantially smallest value, may increase progressively to its largest value, as shown in FIG. 4*a*.

The spring 22 may act on the first arm 7 of the lever to hold the nose 61 against the periphery of the cam 28, the increasing radius of the periphery of the safety body may drive progressive pivoting of the follower 68. In some embodiments, the relative forces of the springs 22 and 65 may be chosen so that the action of the spring 22 may predominate over that of the spring 65.

Accordingly, when the rotation of the mobile 2 has brought it to the FIG. 4*a* position, pivoting of the follower 68 may drive retraction of the first and second retractable fingers 63 and 74. The slope at which the radius of the safety body increases may be chosen so that the two retractable fingers are sufficiently retracted to be out of reach of the counters 8 and 13 when they pass in front of the respective teeth to which they are to transmit the next pulse. The operation of the timepiece movement may, therefore, not be interfered with by any contact that might otherwise occur between each retractable finger and a tooth of the mobile with which it cooperates.

In the configuration shown in FIG. 4*a*, the fingers 63 and 74 may be completely retracted, the follower bearing against the point on the periphery of the safety body having the largest radius.

Figure 4B:
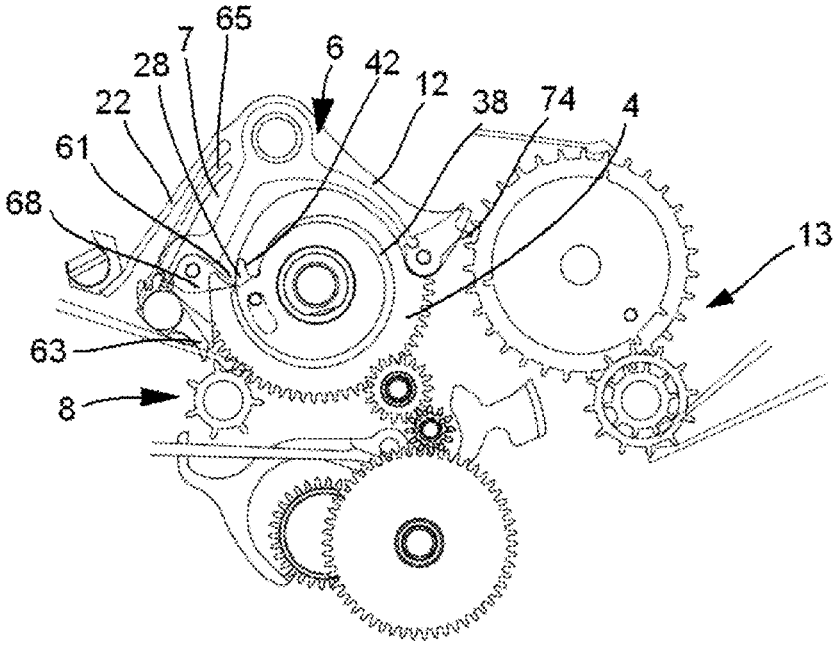

In the configuration shown in FIG. 4*b*, while the nose 61 may continue its travel along the periphery of the cam 28, the follower 68 may pass beyond the point on the safety body of largest radius and reach the slope 39 of the latter. At this moment, the follower 68 may be loaded only by the spring 65, which may cause it to pivot against its abutment surface 77.

At the same time, the two retractable fingers 63 and 74 may leave their retracted positions, turning in the clockwise direction in FIG. 4*b*, so that each may be ready to transmit a pulse to the corresponding counter.

Figure 4C:
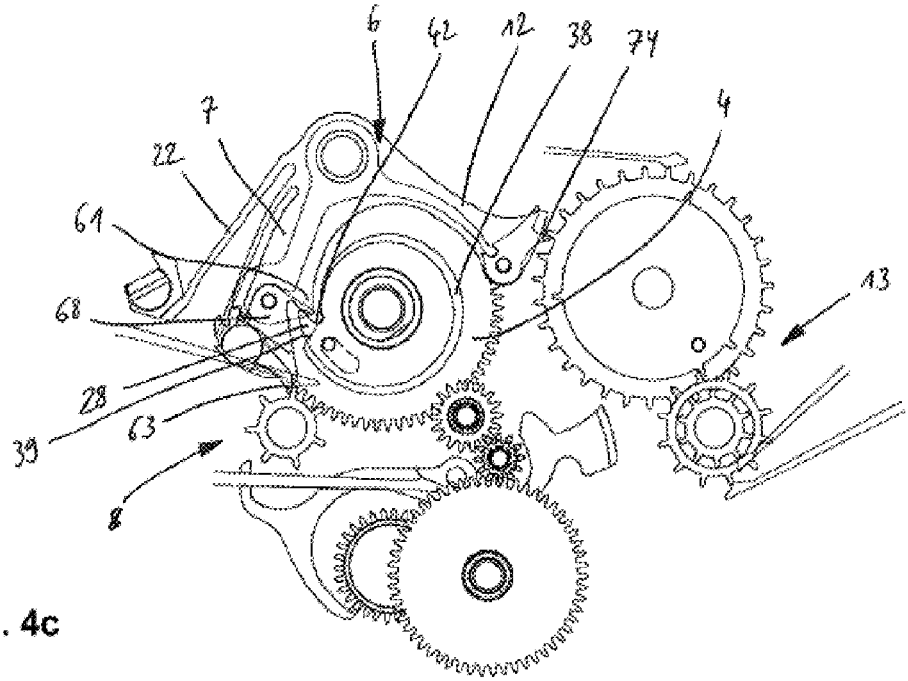

Substantially at midnight, the nose 61 may cross the point on the periphery of the cam 28 of largest radius. At this time, the lever 6 may be pivoted rapidly in the anticlockwise rotation direction by the spring 22, as shown in FIG. 4*c*. At the same time, each of the two retractable fingers 63 and 74 may come into contact with a tooth of the mobile of the corresponding counter to cause it to turn by one step and increment the counter.

Figure 4D:
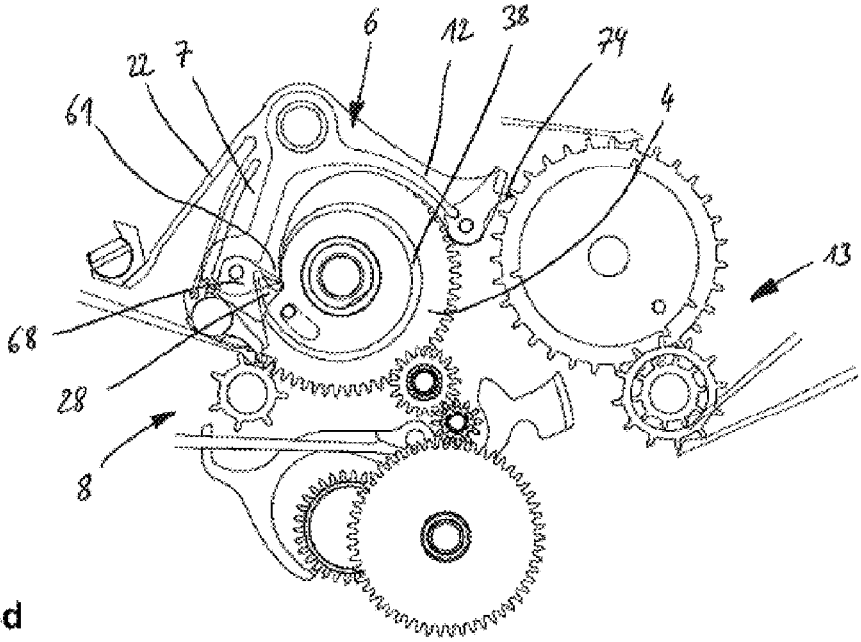

FIG. 4*d* illustrates the configuration of the instantaneous driving mechanism, according to the present disclosure, immediately after midnight, i.e., immediately after the lever 6 has fallen at the level of the junction 42 on the periphery of the cam 28. At this moment, each of the date and day counters has been incremented.

Consider a situation in which a user of a timepiece incorporating the driving mechanism in accordance with the present disclosure wishes to correct information displayed. In the case of correction of the date or the day, a dedicated quick correction mechanism is provided and is described hereinafter. In the case of correction of the current time, it will be noted that any manual rotation by the user of the hour wheel 1 may also drive rotation of the mobile 2 via the set of setting wheels 3.

Thus, if no safety precautions are taken, the operation of setting the time can potentially cause damage when the hour wheel 1 is driven in the anticlockwise rotation direction by virtue of the respective shapes of the nose 61 and the cam 28.

Such a situation is seen in the configuration illustrated in FIG. 4*d*. If the hour wheel is driven in the anticlockwise rotation direction from the position illustrated in FIG. 4*d*, implying rotation of the mobile 2 in the clockwise direction, the junction 42 on the cam 28 may come to be positioned so that it is abutted against the nose 61 of the lever 6. The orientation of the contact interface between the junction 42 and the nose 61 is such that the latter cannot move away from the cam to enable the cam to continue its rotation.

FIGS. 5*a* to 5*e* show the operation of the safety body 38 in relation to the lever 6 to prevent the instantaneous driving mechanism being damaged in such a situation.

When, starting from the FIG. 4*d* configuration, the toothed wheel 4 turns in the clockwise rotation direction, the junction 42 of the cam 28 may abut against the nose 61, which therefore, may immobilize the cam.

Figure 5A:
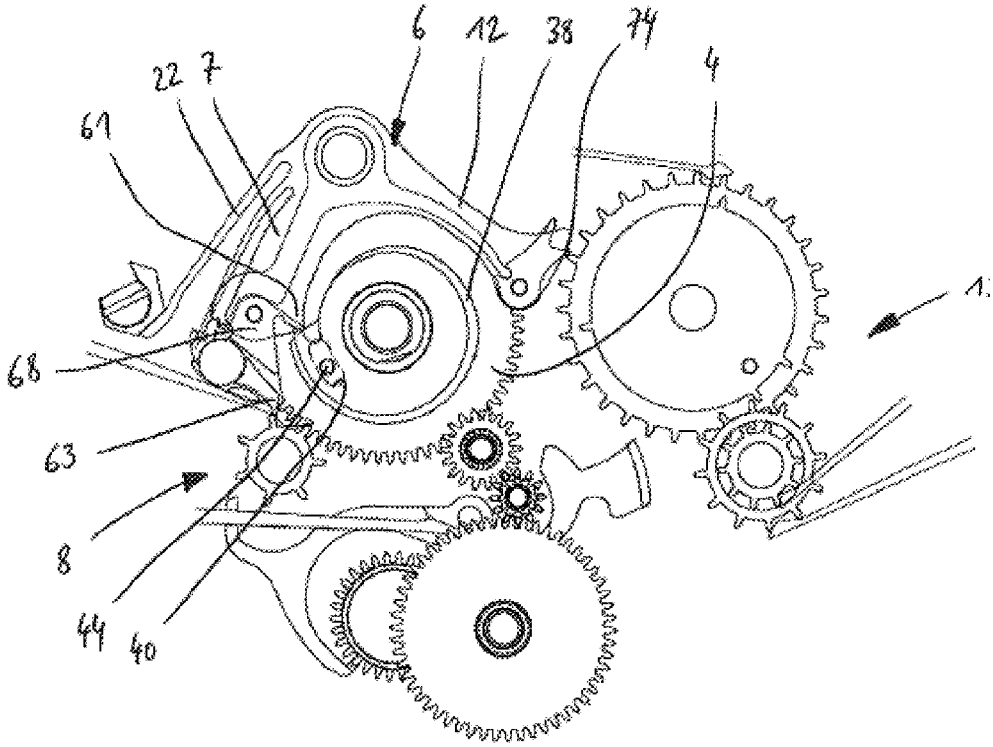
FIGS. 5*a*, 5*b*, 5*c*, 5*d* and 5*e* represent the kinematics of the operation of the exemplary mechanism from FIG. 1, in a second rotation direction, in the same simplified front view.

However, the toothed wheel 4 can continue its travel by virtue of movement of the pin 44 inside the slot 40 in the safety body 38, which may be seen in FIG. 5*a*, the cam 28 remaining immobile.

At the same time, the follower 68 may come into contact with the slope 39 of the safety body, in a position in which it is locked against its abutment surface 77. The rotation of the safety body 38 may therefore drive sliding of the follower 68 along the slope 39, causing the first arm 7 of the lever 6 to be lifted relative to the mobile 2.

Figure 5B:
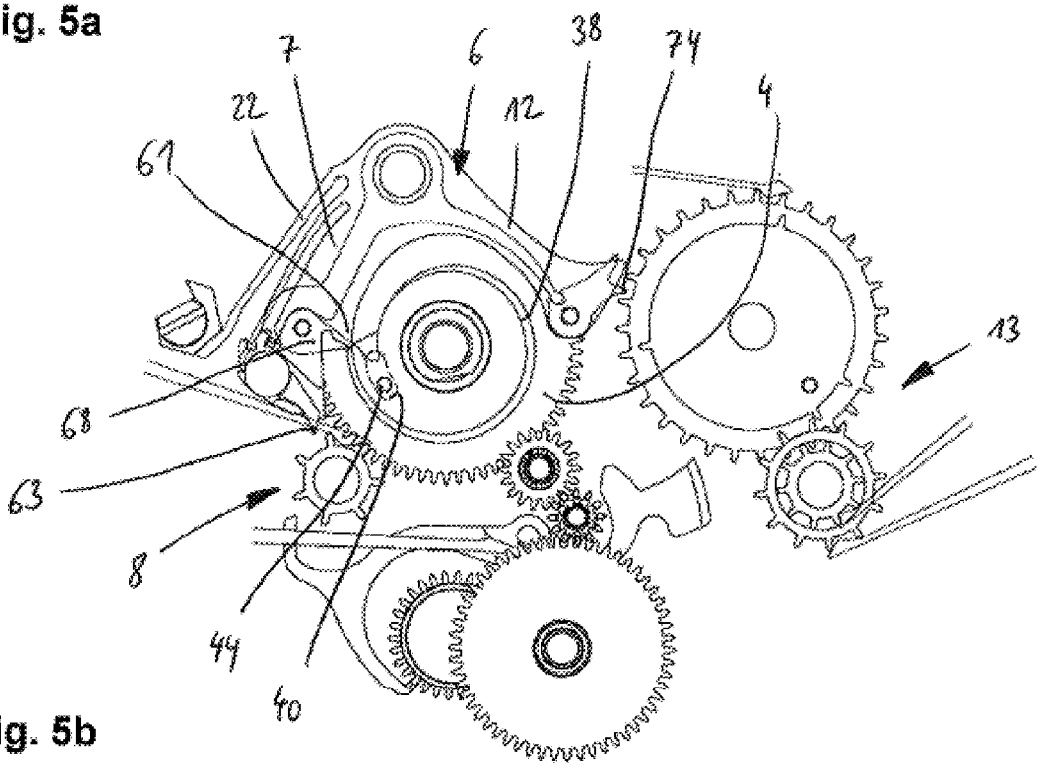

At a certain stage, the tip of the nose 61 may cross the edge defined between the junction 42 and the point on the periphery of the cam 28 with the largest radius to reach the configuration shown in FIG. 5*b*.

Figure 5C:
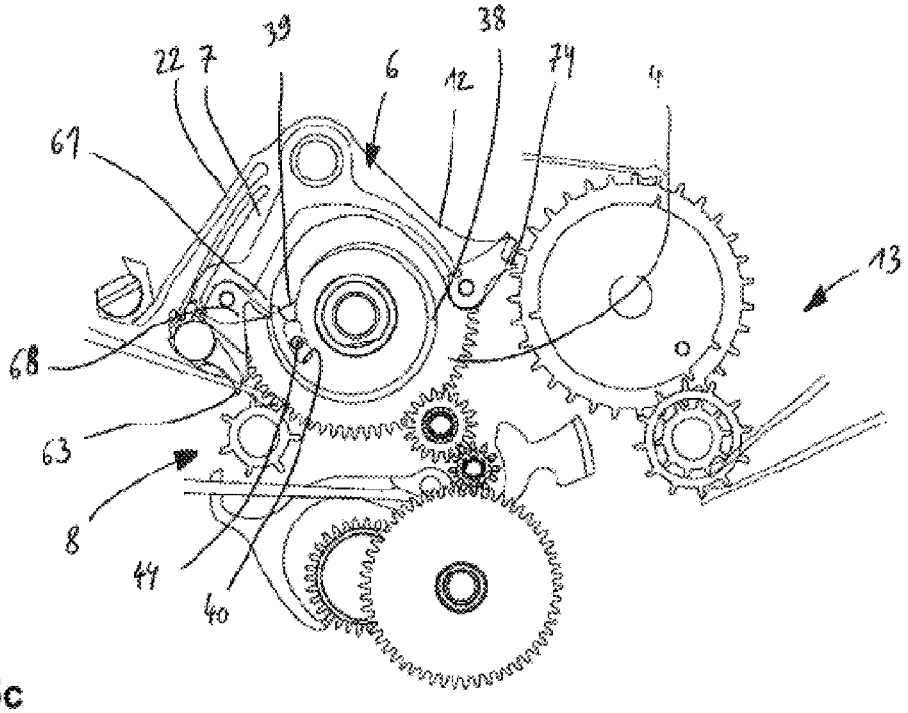

When the follower 68 continues its travel along the slope 39, it may move the first arm 7 farther away from the center of the cam 28, thus enabling the nose 61 to move past the aforementioned edge to reach the configuration shown in FIG. 5*c*. Comparing the configurations of FIGS. 5*b* and 5*c* shows that the cam has pivoted slightly in the clockwise direction by virtue of the action of the spring arm 47 on the pin 44.

Figure 5D:
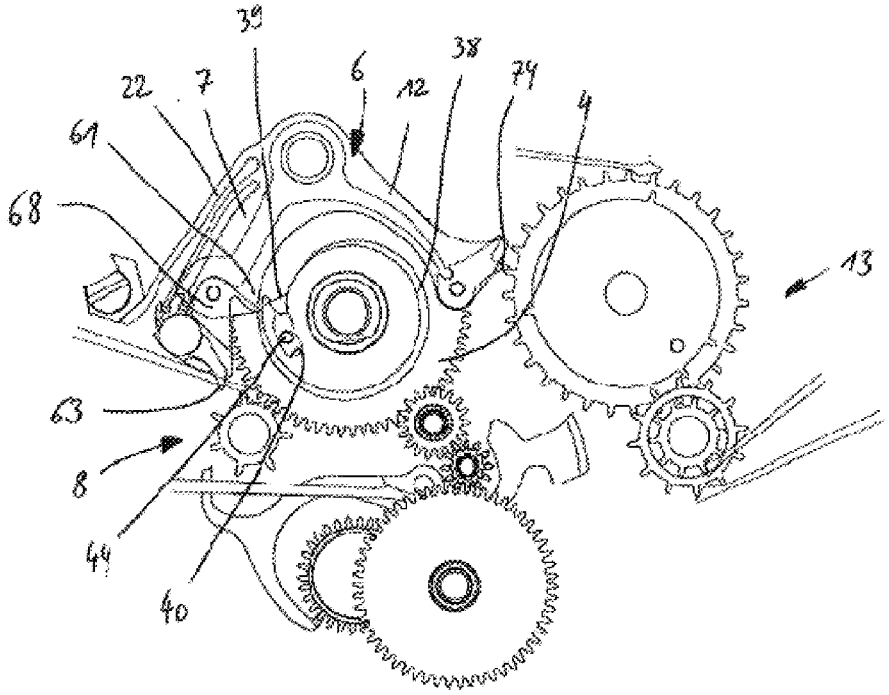

When the follower 68 reaches the point on the safety body 38 of largest radius, the nose 61 may be out of reach of the cam 28, notably as a safety feature, as is clear from the configuration shown in FIG. 5*d*.

Figure 5E:
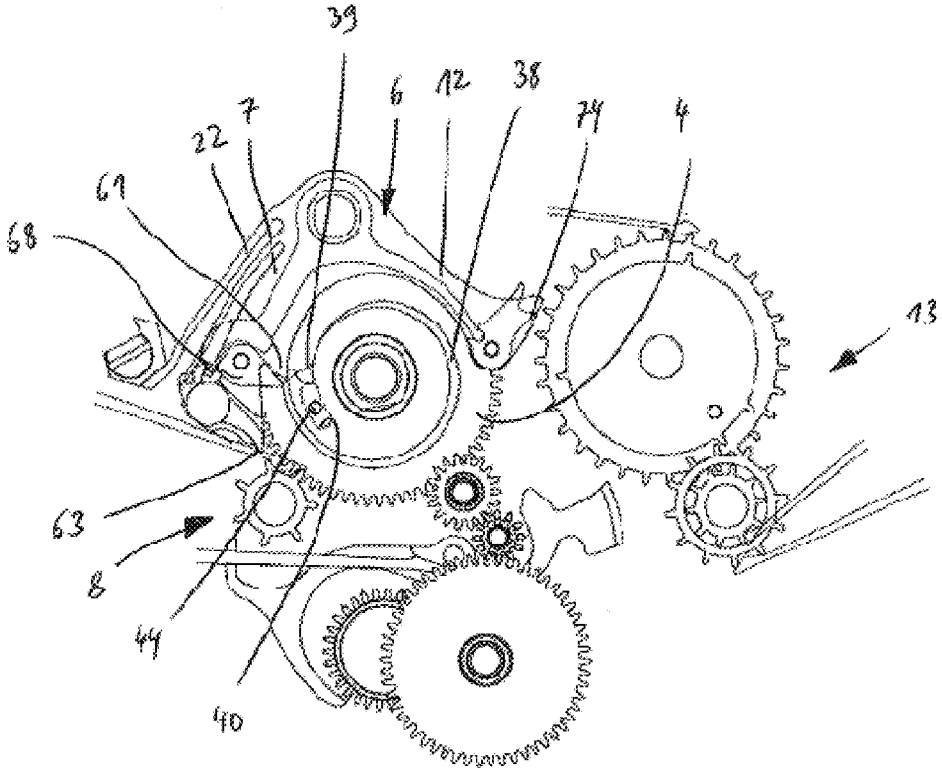

Furthermore, when the follower passes beyond this point of largest radius, the direction of the force on it by virtue of its contact with the periphery of the safety body may change orientation and cause it to pivot, as can be seen in FIG. 5*e*. This pivoting may enable the first arm 7 of the lever 6 to move toward the cam 28 so that the nose 61 again abuts against the periphery of the latter.

During this operation, the display of the current time goes from a position indicating a time just after midnight to a time a few hours before midnight.

Accordingly, as soon as the driving mechanism reaches the FIG. 5*e* configuration, the user can begin to turn the hour wheel in the normal direction, i.e., in the clockwise rotation direction, to change the display of the current time to a time after midnight. In this case, the first toothed wheel 4 begins to turn again in the anticlockwise rotation direction. Initially, the cam 28 may remain substantially immobile, until the slot 40 is again positioned so that it is abutted against the pin 44. At the same time, the follower 68 may assume a position facing the slot 39 and pivot again in the anticlockwise rotation direction in FIG. 5*e*, so as to move the retractable fingers 63 and 74 back into reach of the associated teeth (in a configuration close to that of FIG. 4*b* apart from the relative positions of the slot 40 and the pin 44).

Once the slot 40 is abutted against the pin 44, the cam 28 may again be driven in the anticlockwise rotation direction from the wheel 4. The nose 61 may then rapidly cross the point on the periphery of the cam 28 of largest radius to enable the lever to fall, by virtue of the action of the spring 22, and increment the date and day counters, as described above with reference to FIGS. 4*c* and 4*d*.

It follows from the foregoing description that during operation of the driving mechanism, according to the present disclosure, the position of the lever 6 relative to the cam 28 may be defined by the interaction between the nose 61 and the periphery of the cam. The driving mechanism may behave in a similar manner when the hour wheel 1 is driven manually in the clockwise rotation direction. However, when the hour wheel is driven manually in the anticlockwise rotation direction, the cam and the nose may abut on each other leading to immobilization of the cam and, in some embodiments, the interaction between the follower 68 and the slope 39 of the safety body 38 may enable the nose 61 to pass over the junction 42, to go from the point on the periphery of the cam 28 of smallest diameter to its point of largest diameter, without causing any damage to the mechanism.

It will be noted that the operation of the mechanism, according to the present disclosure, makes it possible to facilitate fitting the hands for a clockmaker responsible for the assembly of a corresponding timepiece. Fitting the current hour and minute hands may be generally effected when the hour wheel and the cannon-pinion are disposed in their position corresponding to midnight, this position being identifiable by the date counter jumping. Accordingly, with a mechanism such as that which described above, the clockmaker may roughly find the midnight position by noting the lever 6 jumping and fit the hands initially without pushing them on completely. The clockmaker may then work backwards to correct the current time manually and then change direction to drive the mechanism in the normal direction again, but more slowly, to detect more precisely the midnight position and then push the hands completely on. Such a procedure cannot be envisaged with conventional mechanisms, which consequently demand more concentration and trial and error by the clockmaker during the fitting of the hands, which is reflected in higher assembly costs. In the case of conventional mechanisms, to reposition the timepiece movement in its configuration corresponding to midnight, the clockmaker must perform two further complete revolutions of the current hour hand to arrive at the same result.

Figure 6:
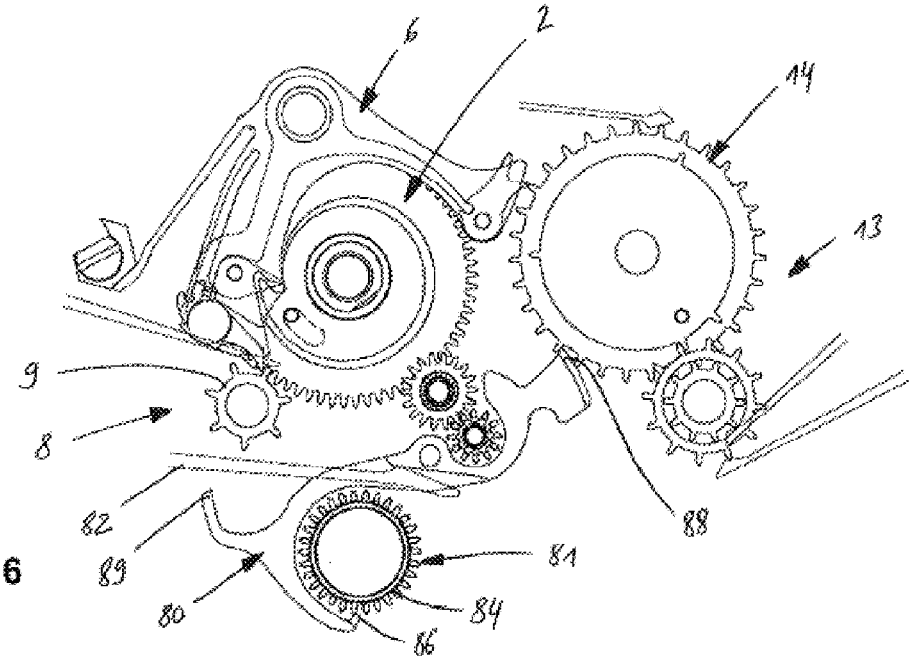
FIG. 6 represents a simplified front view of the instantaneous driving mechanism from FIG. 1 in a first specific mode of operation.
Figure 7:
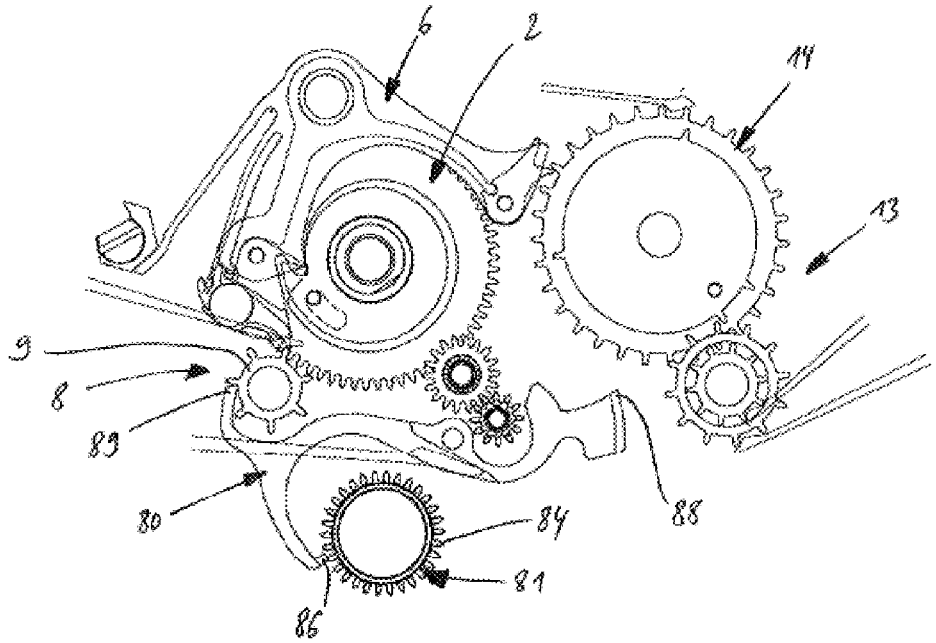
FIG. 7 represents a simplified front view of the instantaneous driving mechanism from FIG. 1 in a second specific mode of operation.

FIGS. 6 and 7 show front views an operation of a mechanism for fast correction of the date and the day that may be used with the driving mechanism described above.

This fast correction mechanism may include a correction lever 80 pivotally mounted on a frame element of the timepiece movement to pivot between at least a neutral first position (as shown in FIG. 4*a*), a second position for correcting the date (as shown in FIG. 6), and a third position for correcting the day (as shown in FIG. 7).

The fast correction mechanism may also include a control mobile 81 configured to define the position of the lever at a given time in relation to the action of a spring 82 acting on the lever 80.

The control mobile 81 may include first and second toothed wheels configured to rotate together. Only one of the first and second toothed wheels can be seen in the figures, namely the first or driving wheel 84. The second or control wheel may include teeth similar to those of the first wheel except that its pitch may be three times that of the first wheel, i.e., it may include only one tooth in three compared to the latter. It will be noted that the two wheels may advantageously be formed in one piece, i.e., in the form of a single wheel of which two teeth in three may be truncated in the direction of the thickness of the wheel.

The first wheel 84 may be configured to be driven in rotation from rotation movements applied to a time-setting spindle, in a conventional way. The kinematic connection between the time-setting spindle and the driving wheel 84 may be conventional, of the type notably including a sliding gear, and is not described in more detail as a person skilled in the art will encounter no particular difficulty in implementing it as a function of what they require.

The control wheel may be adapted to cooperate with a first nose 86 of the lever 80 with the aim of controlling pivoting thereof. The latter may further include second and third noses 88, 89 adapted to transmit pulses to the date and day counters, respectively.

When the time-setting spindle is turned in a first predefined rotation direction causing rotation of the control mobile 81 in the anticlockwise rotation direction, the control wheel may act on the first nose of the lever so as to cause the later to pivot in the anticlockwise rotation direction. The second nose of the lever then may transmit a pulse to the control wheel 14 of the date counter 13 to increment the latter. A situation of this kind is shown in FIG. 6.

When the control wheel effects one rotation step, its tooth that allowed pivoting of the lever may pass beyond the first nose of the latter and release it. Because the next two teeth of the control wheel are truncated, the first nose may have sufficient room to allow the spring 82 to return the lever to its rest position immediately.

If the time-setting spindle is turned further in the same direction, the date counter may be subjected to further successive incrementations, at the rate of one incrementation every three rotation steps of the control wheel.

When the time-setting spindle is turned in the other rotation direction, causing rotation of the control mobile 81 in the clockwise rotation direction, the control wheel may act on the first nose of the lever so as to cause the latter to pivot in the clockwise rotation direction. The third nose of the lever may then transmit a pulse to the gear 9 of the day counter 8 to increment the latter. A situation of this kind is shown in FIG. 7.

When the control wheel performs one rotation step, its tooth that allows pivoting of the lever may pass beyond the first nose of the later and release it. Because the next two teeth of the control wheel are truncated, the first nose may have sufficient room to allow the spring 82 to return the lever to its rest position immediately.

If the time-setting spindle is pivoted further in the same direction, the day counter may be subjected to further successive incrementations, at the rate of one incrementation every three rotation steps of the control wheel.

It will be noted that the driving mechanism in accordance with the present disclosure therefore offers the possibility of adjusting the date at any time without risk of damaging the driving mechanism in accordance with the disclosure, in contrast to known timepieces in which adjustment of the date between 21:00 and 03:00 is to be avoided because it may damage the timepiece movement.

FIG. 8 represents an exploded perspective view of a mobile 102 of another embodiment of the present disclosure.

The general operation of the mobile 102 is similar to that of the mobile 2. In some embodiments, the mobile 102 may comprise a first toothed wheel 104 fastened to a bush 127 on which a cam 128 and a spring member 129 are provided. The hollow central shaft of the bush may be designed to be engaged on a tenon carried by a frame element of the timepiece movement to mount the mobile thereon pivotally.

The bush 127 may include a flat 132 with which an opening 133 of complementary shape formed in the base 145 of the spring member 129 may cooperate. A shoulder 136 may define a radial guide surface for the cam 128 mounted on the bush and free to turn relative to the later.

The bush 127 may also carry a safety body 138. The operation of safety body 138 may be similar to that of the safety body 38 described above.

In some embodiments, the safety body 138 may include a plate, the periphery of which may include a varying radius. In some embodiments, the safety body 138 may comprise a first portion 201 having a first constant radius and extending over slightly more than one half-turn and a second portion 202 having a second constant radius and extending over slightly less than one quarter-turn. While the first portion 201 may be configured to be positioned facing a portion of the cam 128 of small radius, its first radius may be everywhere less than (or equal to) that of the cam. For its part, the second portion 202 may be configured to be positioned facing the portion of the cam 128 having the largest radius and its second radius may be substantially greater than that of the cam in this region. A slope 139 may be inclined relative to the radial direction that defines the junction between the points of largest and smallest radius. The safety body may further comprise a slot 140 extending substantially along a circular trajectory and adapted to receive a pin 144 of the cam 128.

The spring member 129 may comprise a spring arm 147 carrying two fingers 148, 149 in the form of claws facing each other at its free end. The two fingers 148, 149 may be adapted to cooperate with the pin 144. When the mobile 102 is assembled and not externally loaded, the pin 144 may be free to assume a position between the two claws 148 and 149.

Figure 9B:
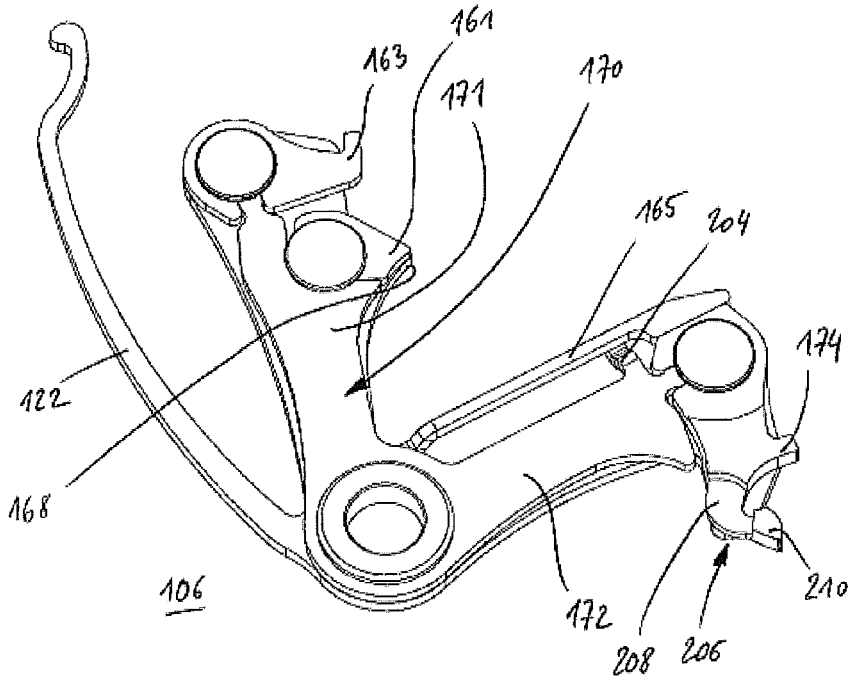
FIG. 9*b* represents a perspective view of a second face of the member of FIG. 9*a;*

FIGS. 9*a* and 9*b* represent perspective views of the first and second faces of a lever 106 that may be configured to cooperate with the mobile 102 described above.

The lever 106 may include a bore 160 for fixing it pivotally to a frame element of the timepiece movement and from which extend first and second arms 107 and 112, together with a spring 122.

The first arm 107 may comprise, in the vicinity of its free end, a nose 161 assembled to the arm so as to have a small pivoting play, as well as a first retractable finger 163 pivotally mounted on the first arm 107 and adapted to transmit pulses to the gear 9 of the day counter 8.

The first arm 107 may also include a follower 168 configured to cooperate with the periphery of the safety body 138.

Moreover, the lever 106 may carry a rocker 170 rotatably mounted on the lever with its rotation axis coaxial with the bore 160 and including first and second arms 171, 172 respectively superposed on the first and second arms 107, 112 of the lever.

The free end of the first arm 171 of the rocker, substantially conformed as a ball-joint, may cooperate with the first retractable finger 163. The free end of the second arm 172 of the rocker, also conformed as a ball-joint, may cooperate with a second retractable finger 174 situated at the free end of the second arm 172 to cause it to pivot substantially simultaneously with the first retractable finger 163.

It will be noted that the rocker 170 and the nose 161 may have facing surfaces of substantially complementary shape so that the first nose guides the rocker and limits the amplitude of its movement.

A spring 165, which may be in one piece with the lever 106, may be adapted to apply a force to the second retractable finger 174 to define a rest position thereof. At the same time, by way of the second finger 174 and the rocker 170, the spring 165 may define the rest position of the first finger 163. Note that a lug 204 may be provided on the rocker 170 to guide the spring 165.

Moreover, as shown in FIG. 9*b*, the second finger 174 may have an extension 206 having a bent first portion 208 followed by a third finger 210 defining a guide member, as explained hereinafter with reference to the subsequent figures. The first portion 208 may be thinner than the second finger 174 and the third finger 210 may be thicker than the second finger.

FIGS. 10*a* to 10*i* show the kinematics of operation of the instantaneous driving mechanism, in accordance with another embodiment of the present disclosure, in a first rotation direction, in a simplified front view similar to that of FIGS. 4*a* to 4*d*. In some embodiments, the first rotation direction may be the direction of normal operation of the mechanism, i.e., notably when it is driven by the finishing wheel. In such operation, the hour wheel 1 may turn in the clockwise rotation direction in FIGS. 10*a* to 10*i*, which may correspond to rotation of the mobile 102 in the anticlockwise rotation direction.

Figure 10A:
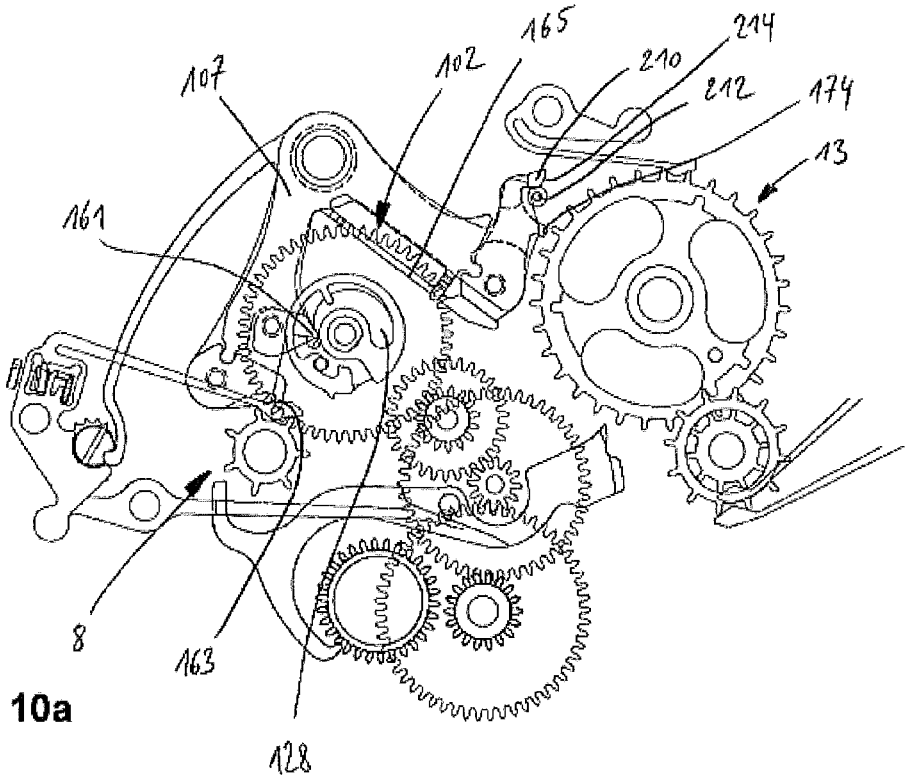
FIGS. 10*a*, 10*b*, 10*c*, 10*d*, 10*e*, 10*f*, 10*g*, 10*h* and 10*i* represent the kinematics of operation of the mechanism in accordance with the another embodiment, in a first rotation direction, in the same simplified front view.
Figure 10B:
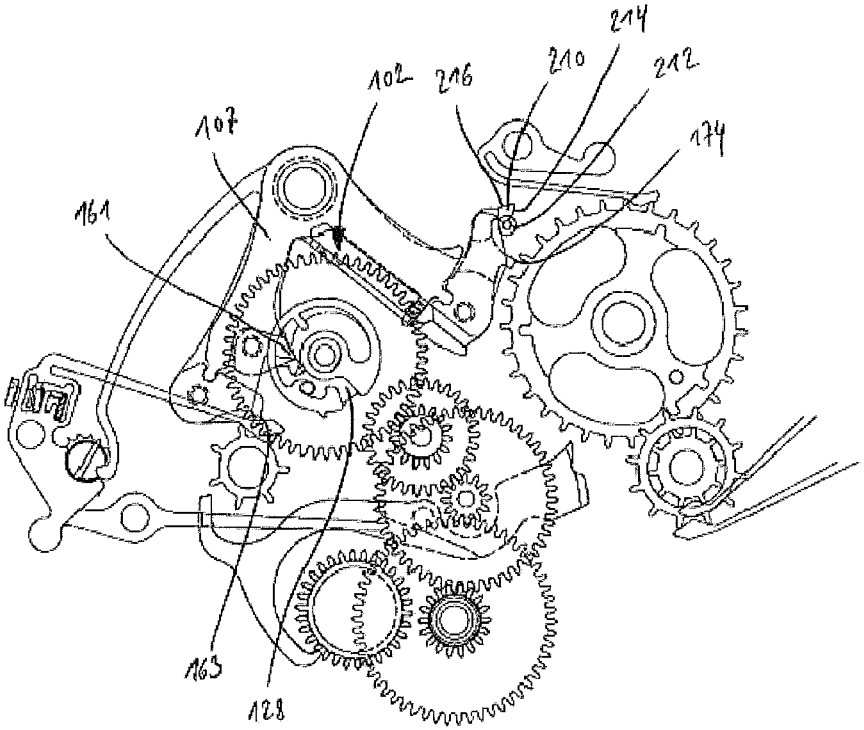
Figure 10C:
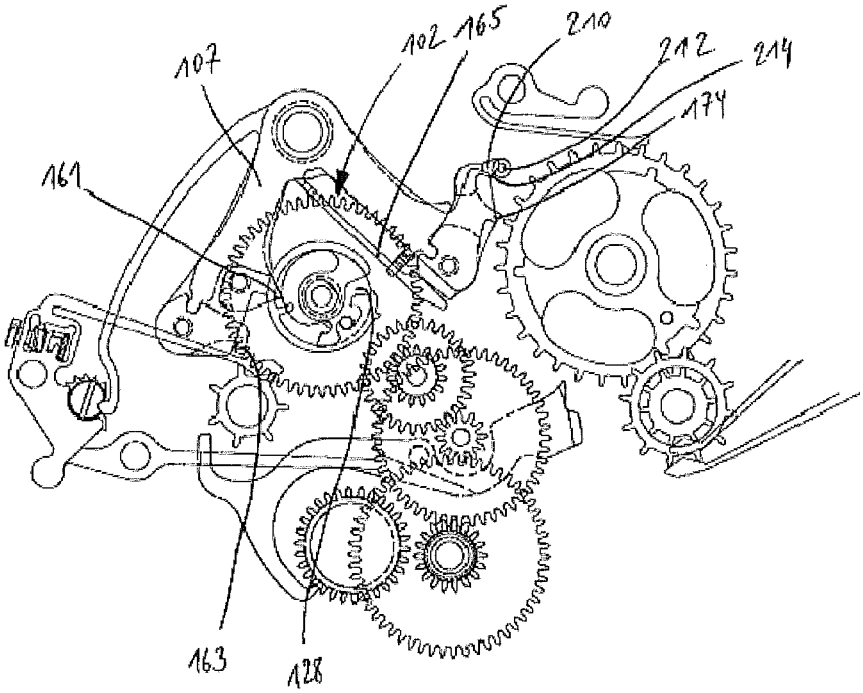
Figure 10D:
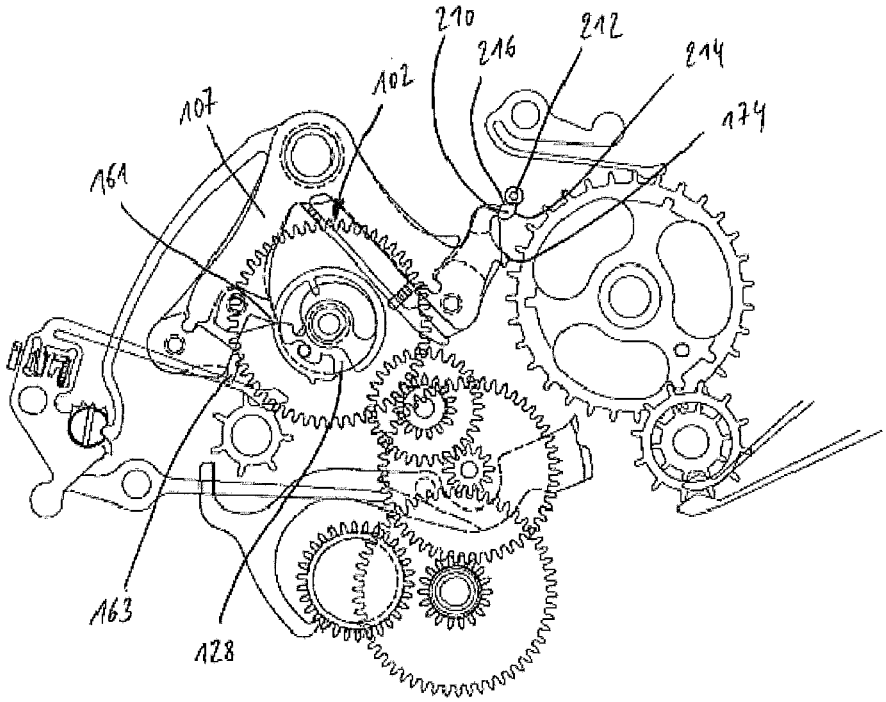

Starting from the smallest radius of the periphery of the cam 128, associated with a time immediately after midnight on a given day (as shown in FIG. 10*a*), the nose 161 may follow the periphery of the cam 128 for almost 24 hours, as far as the position shown in FIG. 10*d*, which corresponds to a time close to midnight on the next day. In some embodiments, being driven in the anticlockwise rotation direction, the wheel 104 may drive the cam 128 in the same direction by virtue of cooperation of its stop 140 with the pin 144 carried by the cam 128.

The radius of the periphery of the cam 128 facing the nose 161 may progressively increase, and the lever 106 may pivot slowly in the clockwise direction, at the same time, so that its first arm 107 may move progressively away from the center of the cam 128.

As shown in FIGS. 10*a* to 10*i*, a fixed pin 212 may be arranged on the frame of the timepiece movement so as to cooperate with the extension 206 fastened to the second finger 174.

In some embodiments, during the hours before midnight a curved first face 214 of the third finger 210 may rest on the pin 212.

As the lever 106 pivots in the clockwise rotation direction, going from the FIG. 10*a* configuration to that of FIG. 10*d*, the third finger 210 may be retained by the pin 212, which may force the plate carrying the second finger 174 to pivot progressively in the anticlockwise rotation direction to pass over the top of the pin as seen in the figures.

This rotation of the second finger 174 may drive rotation of the rocker 170 in the clockwise direction relative to the lever 106, thereby driving pivoting of the first finger 163 in the anticlockwise rotation direction. Accordingly, the more the lever turns, the more the first and second fingers 163 and 174 may be retracted and able to pass in front of the teeth with which they cooperate without being within their reach.

Just before the change of date and day, the third finger 210 may pass the pin, as can be seen in FIG. 10*d*, and may be returned to its rest position by the spring 165. The first and second fingers 163 and 174 may then pivot in the opposite direction to move toward the teeth with which they cooperate.

Figure 10E:
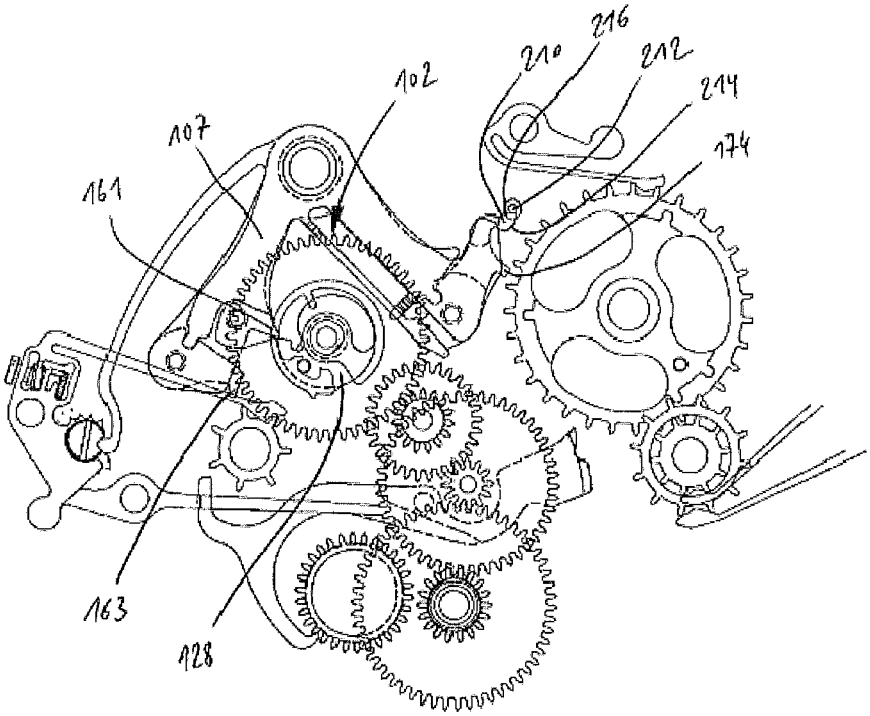
Figure 10F:
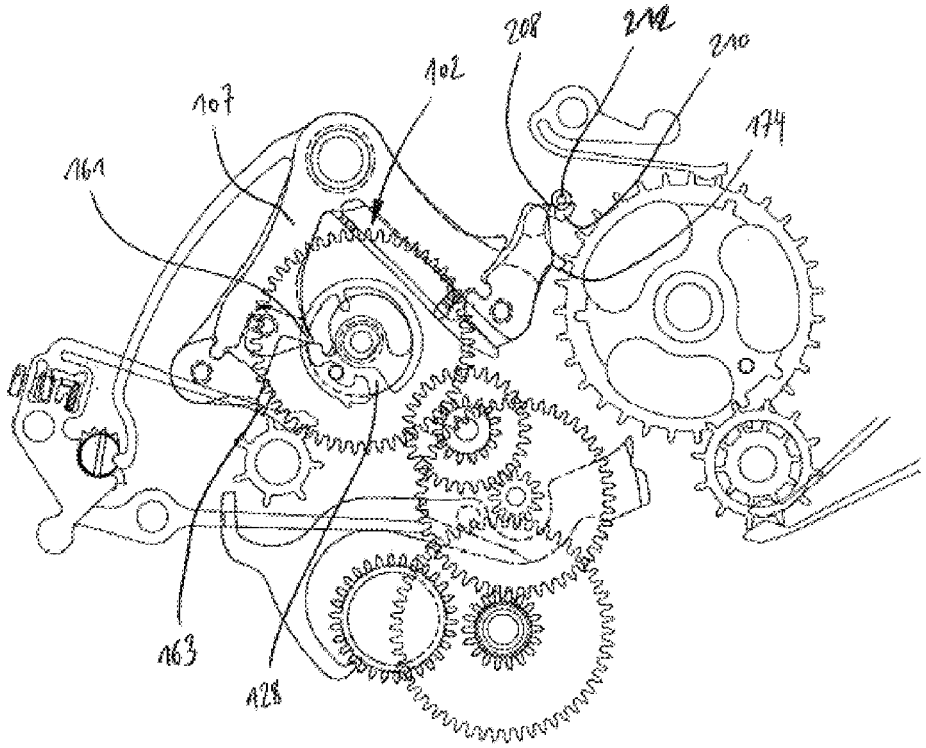

In FIGS. 10*e* and 10*f*, the cam 128 may continue to rotate and drive the lever 106; also, the third finger 210 may be again abutted against the pin 212, this time via a second face 216 opposite the first face 214. The plate carrying the extension 206 and the second finger 174 may then pivot in the clockwise rotation direction, driving the first finger 163 in the same direction via the rocker 170.

As shown in FIG. 10*f*, the nose 161 may leave the point on the periphery of the cam 128 with the largest radius in the anticlockwise rotation direction and cause the lever 106 to fall. The first and second fingers 163 and 174 may be within reach of the teeth with which they cooperate.

Figure 10G:
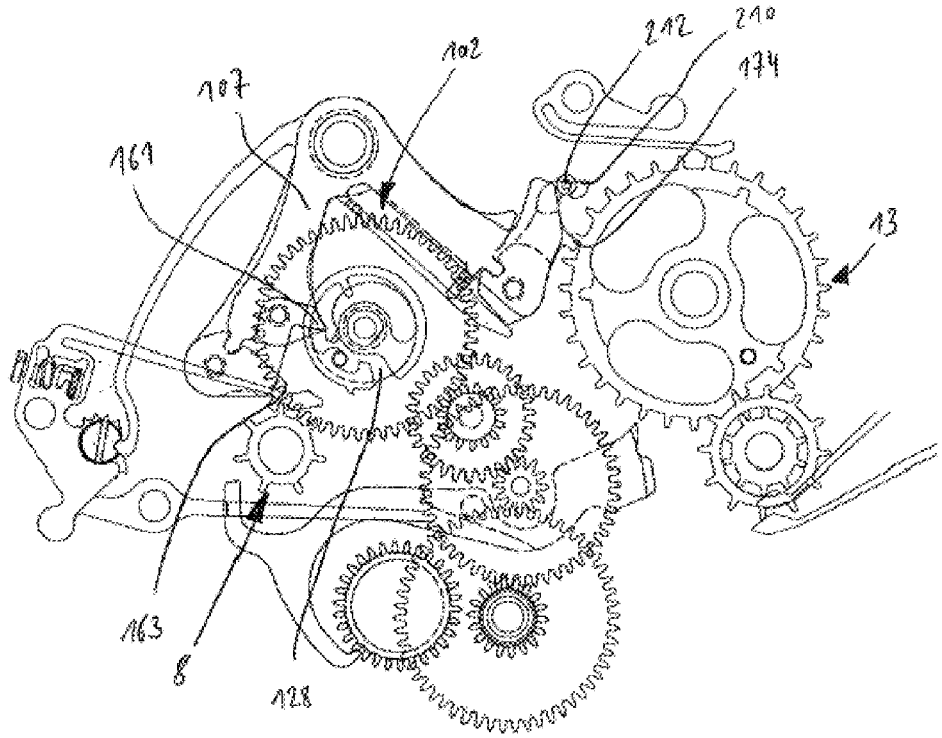

As shown in FIG. 10*g*, as the lever 106 falls, the face 216 of the third finger 210 may slide along the pin 212 until the latter faces the bent first portion 208 of the extension 206.

Figure 10H:
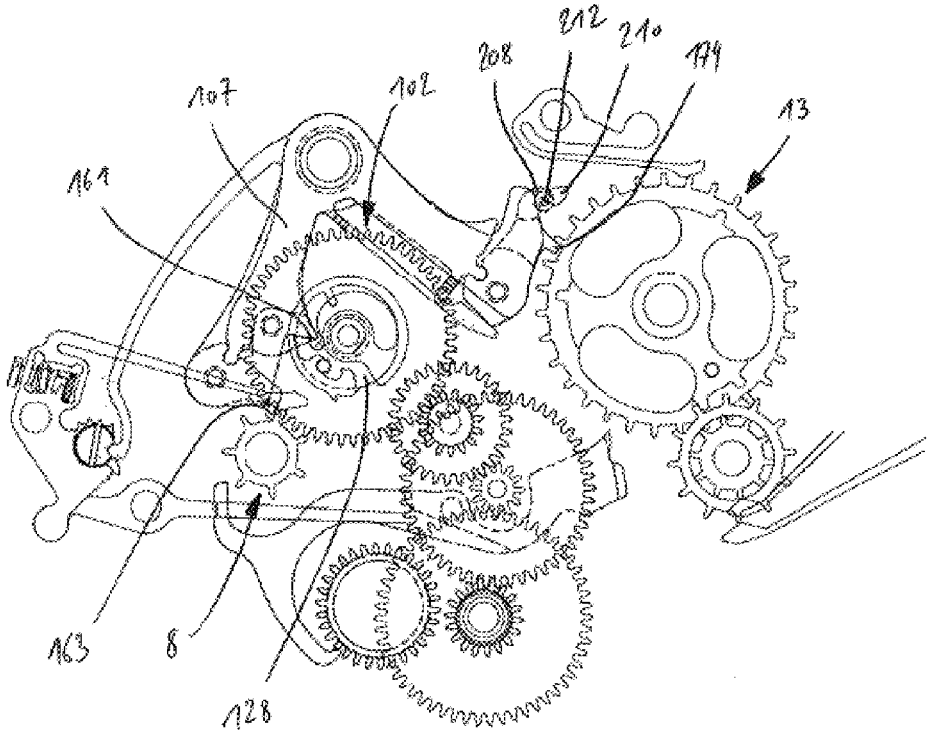

The thickness of the first portion 208 may be chosen so that the pin 212 may cross the extension 206, as shown in FIG. 10*h*, while the lever 106 continues to fall.

Figure 10I:
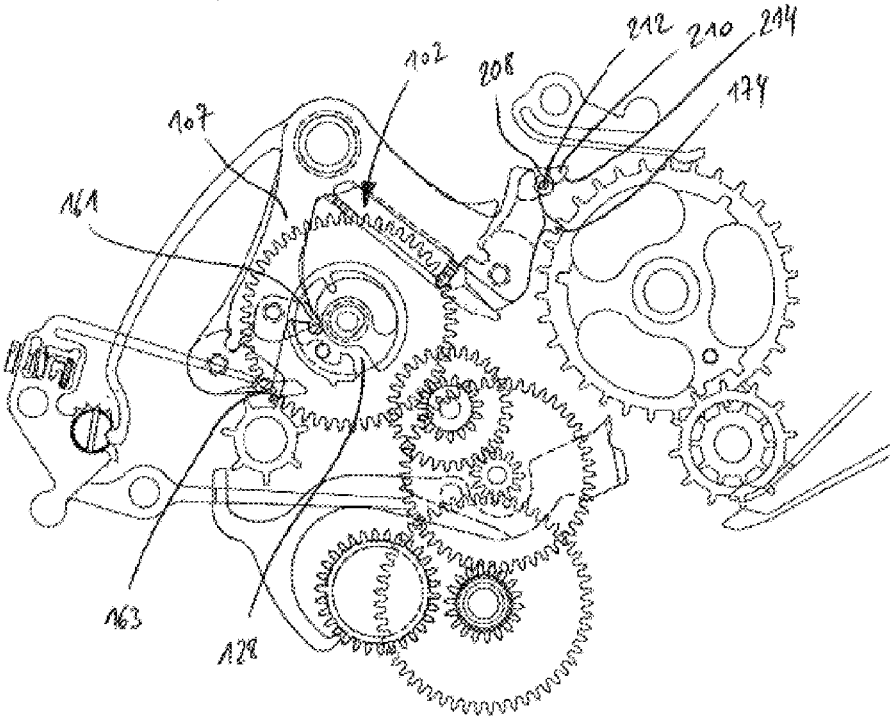

At this moment, by virtue of the action of the falling lever 106, each of the fingers 163 and 174 may transmit a pulse to the wheel that it drives, as shown in FIG. 10*i*.

The mechanism may then return to the position shown in FIG. 10*a*.

If a user corrects the time backwards, the mechanism in accordance with the present embodiment may react in a similar way to what has been described with reference to the first embodiment.

The safety body 138 may act on the lever 106 via the follower 168 to cause it to pivot in the clockwise rotation direction.

As the lever 106 rises, the third finger 210 may trace the predefined path by virtue of its cooperation with the pin 212, as has just been described with reference to FIGS. 10*a* to 10*d*.

At this stage, whichever direction the wheel 104 is driven in, the third finger 210 may behave as described above with reference to FIGS. 10*e* to 10*i*, and each of the first and second fingers 163, 174 may transmit a pulse to the corresponding wheel.

It is clear from the foregoing description of the mechanism, according to the present disclosure, offers additional safety, as compared to the first embodiment, by, for example, preventing multiple jumps of the wheels 9 and 14 during operation of the mechanism or even unintended jumps in the case of impacts.

Figure 11:
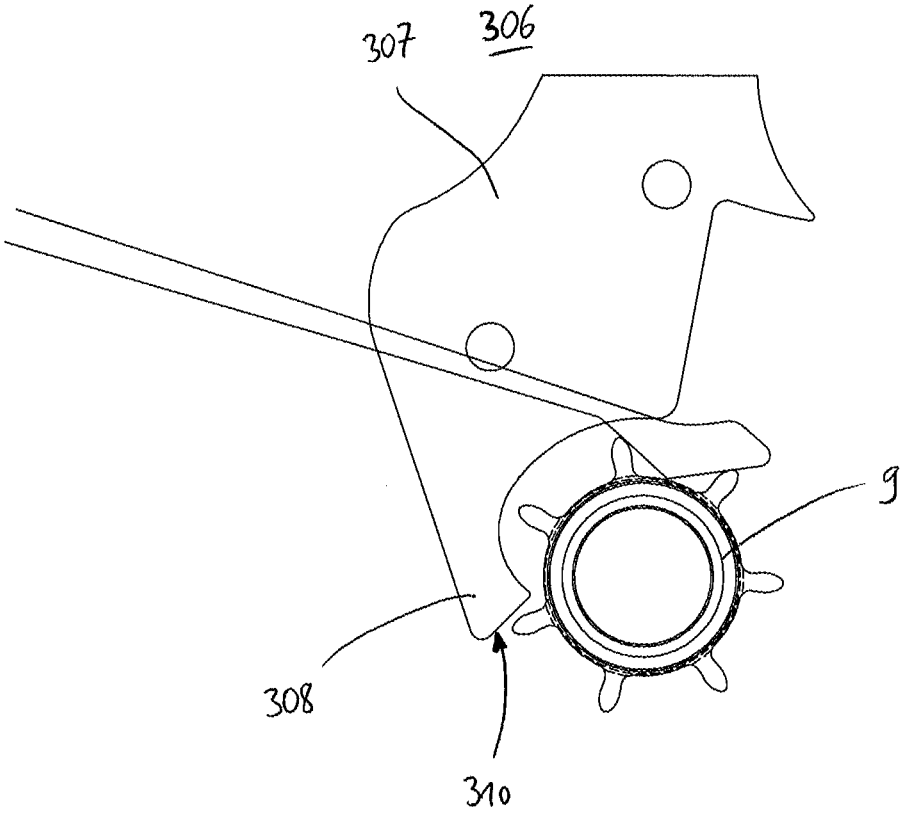
FIG. 11 represents a front view of a construction detail of yet another embodiment of the present disclosure.

FIG. 11 represents a front view of a construction detail of a further variant of the present disclosure. A lever 306 may be similar to the lever 106 in FIG. 9*a* except for the end of its first arm 307, which may interact with the gear 9 having seven teeth, having an additional extension 308 configured to increase the level of safety of the device in relation to the risk of double jumps of the member for showing the day of the week.

In some embodiments, extension 308 may substantially take the form of a nose arranged within reach of the teeth of the gear 9 so that a wall 310 of the nose may define an abutment for these teeth in the clockwise rotation direction. Accordingly, when the lever 306 pivots relative to the lever 106 and in the manner described with reference to FIGS. 10*h* and 10*i* to increment the display of the day, the extension 308 may be positioned between two teeth of the gear 9 to substantially eliminate all risk of double jumps.

It will be noted that the inclination of the wall 310 relative to the teeth of the gear 9 may enable the latter to exert a force on the extension 308 to raise the lever 306 when correcting the day using the correction lever 80, as shown in FIG. 7.

The foregoing description is intended to describe particular embodiments by way of nonlimiting illustrations and the disclosure is not limited to the particular features that have just been described, such as the nature of the information displayed, for example, or the fact that the levers 6, 106 comprise two arms for actuating two counters simultaneously. Similarly, the represented shapes of the various components of the driving mechanism disclosed herein are not limiting.

A person skilled in the art will have no particular difficulty in adapting the content of the present disclosure to their own requirements, without departing from the scope of the present disclosure, by producing an instantaneous driving mechanism including a mobile adapted to turn in a predefined direction, in a normal mode of operation, and to drive movement of a lever with the aim of transmitting instantaneous pulses to at least one counter of a timepiece movement, the mechanism further including a safety body coaxial with the mobile and adapted to allow rotation of the mobile in the opposite direction without risk of damage.

For example, with respect to additional embodiments, it is possible without departing from the scope of the present disclosure to interchange the positions of the third finger 210 and the fixed pin 212, i.e., for the cam defined by the third finger to be fixed to the frame of the timepiece movement while the pin is carried by the extension 206 of the second finger 174. Moreover, the present disclosure is not limited either to the use of a single third finger and pin assembly. In fact, it is possible to provide a similar assembly to command the transmission of pulses to the day counter, for example, or any other information displayed in the context of other applications. The rocker 170 may no longer be necessary in this case. It is then possible to adjust independently of each other the penetrations of the first and second fingers 163, 174 into the associated teeth.

Moreover, it will be noted that the periphery of the cam may feature a curve designed as a function of the force of the spring 22, 122 so that it turns at substantially constant torque.

What is claimed is:

1. An instantaneous driving mechanism for a timepiece movement, comprising:

a mobile comprising a first wheel driven by a driving member of the timepiece movement and configured to drive rotation of a first cam of the mobile; and a lever mounted pivotally on at least one frame element of the timepiece movement, the lever being configured to cooperate with the mobile in order to be moved and to cooperate with a counter of the timepiece movement to increment the counter by instantaneous pulses, wherein the first cam is coaxial with the first wheel and has a periphery of varying radius, wherein the first cam is configured to cooperate with a nose carried by a first arm of the lever and to move the first arm progressively away from the center of the mobile when the first arm turns in a first rotation direction, before allowing the lever to fall, by virtue spring force, when the nose moves from a point on the periphery corresponding to the largest radius to a point on the periphery corresponding to the smallest radius, and wherein the mobile further comprises a safety body coaxial with the first wheel and configured to cooperate with the lever to move the first arm away from the center of the mobile when the first arm turns in a second rotation direction and to allow the nose to go from the point corresponding to the smallest radius to the point corresponding to the largest radius.

2. The instantaneous driving mechanism of claim 1, wherein the safety body comprises a kinematic connection with the first cam such that they are angularly mobile relative to each other between first and second relative angular positions, the first position associated with the first rotation direction and in which the nose cooperates with the cam to define the position of the lever, and the second position associated with the second rotation direction and in which the safety body cooperates with the lever to define its position.

3. The instantaneous driving mechanism of claim 2, wherein the safety body further comprises a plate coaxial with the first cam and having a slope at its periphery, inclined relative to the radial direction and extending between points respectively corresponding to the smallest radius and the largest radius of the plate, the plate and the first cam being configured to rotate together by a spring member configured to allow relative angular movement thereof between the first and second positions.

4. The instantaneous driving mechanism of claim 3, wherein the mobile further comprises a pin fastened to one of the first cam and the safety body, and a portion the pin is arranged in a slot of predefined length provided in the other of the first cam and the safety body to define the two relative angular positions.

5. The instantaneous driving mechanism of claim 4, wherein the spring member has a base configured to rotate with the first cam and the safety body including the slot, and a finger is configured to cooperate with the pin to position the first cam and the safety body in the direction of the first relative angular position.

6. The instantaneous driving mechanism of claim 1, wherein the lever includes a first retractable finger configured to act at least indirectly on the first counter and to transmit the pulses to it, the lever further including a retractor device configured to be driven by the mobile, to act on the first retractable finger and move the first retractable finger so that it is out of reach of the first counter when the first arm is moved away from the center of the mobile, and to release the first retractable finger before the lever falls so that it can transmit a pulse to the first counter.

7. The instantaneous driving mechanism of claim 3, wherein the lever includes a first retractable finger configured to act at least indirectly on the first counter and to transmit the pulses to it, the lever further including a retractor device driven by the mobile, to act on the first retractable finger and move the first retractable finger so that it is out of reach of the first counter when the first arm is moved away from the center of the mobile, and to release the first retractable finger before the lever falls so that it can transmit a pulse to the first counter, and the retractor device includes a follower pivotally mounted on the lever and configured to cooperate with the periphery of the plate of the safety body, the plate having a radius increasing from the point with the smallest radius to the point with the largest radius, the retractor device further configured to cooperate at least indirectly with the first retractable finger.

8. The instantaneous driving mechanism of claim 1, wherein the lever includes a retractable finger configured to act at least indirectly on a counter and to transmit the pulses to the counter, and the mechanism further comprises a retractor device configured to act on the retractable finger and to move the retractable finger so that it is out of reach of the counter when the first arm is moved away from the center of the mobile, the retractor device further configured to release the retractable finger before the lever falls so that it can transmit a pulse to the counter.

9. The instantaneous driving mechanism of claim 8, wherein the retractor device includes a guide member fastened to the retractable finger and configured to cooperate with a fixed pin following a predefined path in response to the movement of the lever.

10. The instantaneous driving mechanism of claim 6, wherein the lever includes a second arm carrying an additional retractable finger configured to cooperate with a second counter of the timepiece movement to increment the second counter by instantaneous pulses substantially simultaneous with those acting on the first counter, and the retractor device is configured to act also on the second retractable finger to move the second retractable finger so that it is out of reach of the second counter when the first arm is moved away from the center of the mobile and to release the second retractable finger before the lever falls so that it can transmit a pulse to the second counter.

11. The instantaneous driving mechanism of claim 10, wherein the retractor device includes a rocker pivotally mounted on the lever and having first and second ends configured to cooperate with the retractable finger and with the additional retractable finger, respectively, so that rotation of one of the retractable fingers drives rotation of the other of the retractable fingers via the rocker.

12. The instantaneous driving mechanism of claim 2, wherein the lever comprises a first retractable finger configured to act at least indirectly on the first counter and to transmit the pulses to it, the lever further comprising a retractor device configured to be driven by the mobile, to act on the first retractable finger and to move the first retractable finger so that it is out of reach of the first counter when the first arm is moved away from the center of the mobile, and to release the first retractable finger before the lever falls so that it can transmit a pulse to the first counter.

13. The instantaneous driving mechanism of claim 3, wherein the lever comprises a first retractable finger configured to act at least indirectly on the first counter and to transmit the pulses to it, the lever further comprising a retractor device configured to be driven by the mobile, to act on the first retractable finger and to move the first retractable finger so that it is out of reach of the first counter when the first arm is moved away from the center of the mobile, and to release the first retractable finger before the lever falls so that it can transmit a pulse to the first counter.

14. The instantaneous driving mechanism of claim 4, wherein the lever comprises a first retractable finger configured to act at least indirectly on the first counter and to transmit the pulses to it, the lever further comprising a retractor device configured to be driven by the mobile, to act on the first retractable finger and to move the first retractable finger so that it is out of reach of the first counter when the first arm is moved away from the center of the mobile, and to release the first retractable finger before the lever falls so that it can transmit a pulse to the first counter.

15. The instantaneous driving mechanism of claim 5, wherein the lever comprises a first retractable finger configured to act at least indirectly on the first counter and to transmit the pulses to it, the lever further comprising a retractor device configured to be driven by the mobile, to act on the first retractable finger and to move the first retractable finger so that it is out of reach of the first counter when the first arm is moved away from the center of the mobile, and to release the first retractable finger before the lever falls so that it can transmit a pulse to the first counter.

16. The instantaneous driving mechanism of claim 6, wherein the lever comprises a first retractable finger configured to act at least indirectly on the first counter and to transmit the pulses to it, the lever further comprising a retractor device configured to be driven by the mobile, to act on the first retractable finger and to move the first retractable finger so that it is out of reach of the first counter when the first arm is moved away from the center of the mobile, and to release the first retractable finger before the lever falls so that it can transmit a pulse to the first counter.

17. The instantaneous driving mechanism of claim 16, wherein the retractor device comprises a guide member fastened to the retractable finger and configured to cooperate with a fixed pin following a predefined path in response to the movement of the lever.

18. The instantaneous driving mechanism of claim 9, wherein the lever includes a second arm carrying an additional retractable finger configured to cooperate with a second counter of the timepiece movement to increment the second counter by instantaneous pulses substantially simultaneous with those acting on the first counter, and the retractor device is configured to act also on the second retractable finger to move the second retractable finger so that it is out of reach of the second counter when the first arm is moved away from the center of the mobile and to release the second retractable finger before the lever falls so that it can transmit a pulse to the second counter.

19. The instantaneous driving mechanism of claim 17, wherein the lever includes a second arm carrying an additional retractable finger configured to cooperate with a second counter of the timepiece movement to increment the second counter by instantaneous pulses substantially simultaneous with those acting on the first counter, and the retractor device is configured to act also on the second retractable finger to move the second retractable finger so that it is out of reach of the second counter when the first arm is moved away from the center of the mobile and to release the second retractable finger before the lever falls so that it can transmit a pulse to the second counter.

20. The instantaneous driving mechanism of claim 18, wherein the retractor device includes a rocker pivotally mounted on the lever and having first and second ends configured to cooperate with the retractable finger and with the additional retractable finger, respectively, so that rotation of one of the retractable fingers drives rotation of the other of the retractable fingers via the rocker.

* * * * *

UNITED STATES PATENT AND TRADEMARK OFFICE

CERTIFICATE OF CORRECTION

PATENT NO. : 8,750,080 B2
APPLICATION NO. : 14/034533
DATED : June 10, 2014
INVENTOR(S) : Tran et al.

It is certified that error appears in the above-identified patent and that said Letters Patent is hereby corrected as shown below:

On the Title Page, add Item (30), the Foreign Application Priority Data as follows:

--March 23, 2011 (FR).....1152402--

Signed and Sealed this
Third Day of February, 2015

Michelle K. Lee

Michelle K. Lee
*Deputy Director of the United States Patent and Trademark Office*